United States Patent [19]

Shiramasa et al.

[11] Patent Number: 4,825,503

[45] Date of Patent: May 2, 1989

[54] BRAKING APPARATUS FOR DOOR CLOSER

[75] Inventors: Miyoshi Shiramasa; Katsuhiko Okano, both of Hiroshima, Japan

[73] Assignee: Ryobi Ltd., Hiroshima, Japan

[21] Appl. No.: 118,924

[22] Filed: Nov. 10, 1987

[30] Foreign Application Priority Data

Nov. 10, 1986 [JP] Japan ..... 61-173017[U]

[51] Int. Cl.[4] ..... E05F 3/06

[52] U.S. Cl. ..... 16/52; 16/76; 16/82; 188/306; 188/310; 267/217

[58] Field of Search ..... 16/51, 52, 66, 76, 82, 16/84; 188/306, 310; 267/118, 217, 223

[56] References Cited

U.S. PATENT DOCUMENTS

| | | | |
|---|---|---|---|
| 3,446,317 | 5/1969 | Cryglas | 16/51 |
| 4,325,164 | 4/1982 | Sasaki | 16/52 |
| 4,423,800 | 1/1984 | Kobiske et al. | 16/51 |

FOREIGN PATENT DOCUMENTS

| | | | |
|---|---|---|---|
| 2635906 | 2/1978 | Fed. Rep. of Germany | 188/310 |

*Primary Examiner*—Richard K. Seidel

*Attorney, Agent, or Firm*—Sughrue, Mion, Zinn, Macpeak and Seas

[57] ABSTRACT

An improved door closer which prevents overly rapid closing due to an external force, such as wind pressure, being exerted on the door. A pair of oil holes are formed communicating with a first pressure chamber and a non-pressure chamber formed in the main cylinder of the closer. A slide valve is disposed in a communicating hole communicating with the oil holes and extending generally perpendicular to the cylinder. A head portion and a braking valve portion are formed on the valve rod of the slide valve at positions corresponding to the oil holes. An elastic member urges the slide valve in the direction opposite to the normal flow direction of the operating oil when the door is closing. An adjusting screw controls the position of the slide valve.

6 Claims, 3 Drawing Sheets

BRAKING APPARATUS FOR DOOR CLOSER

BACKGROUND OF THE INVENTION

The present invention relates to a braking apparatus for a door closer.

In a door closing operation controlled by such a door closer, it is desired that either the closing operation be completely done at a fixed speed, or rapidly in an initial stage through a predetermined initial portion of the closure angular range and then fully closed more slowly in the remainder of the range. The speed change is effected by an adjusting valve or the like.

Such a conventional door closer, however, cannot properly resist an external force such as wind pressure acting on the door during the door closing direction. In such a case, the door may be rapidly fully closed even in the remaining part of the angular range, thereby causing damage to the door or its attachments, or the door frame, or smashing someone's finger or hand. Hence, the conventional door closer involves substantial safety problems.

SUMMARY OF THE INVENTION

It is therefore an object of the present invention to eliminate the above-mentioned disadvantages in the prior art door closers.

It is another object of the present invention to provide a braking apparatus for a door closer in which, while the door is closing at a speed adjusted by a slide valve in a normal state, the door is provided with resistance to external forces acting in the door closing direction in such a manner that the slide valve is actuated by stopping the flow of operating oil to thereby cause the door to stop and then close slowly.

In order to attain the above objects, a door closer is provided including a rotor mounted within an operating cylinder. A first pressure chamber and a second pressure chamber are formed in the operating cylinder, and a check valve is provided on a blade within the cylinder. When the door is opened, a torsion spring is subject to torsion by a main shaft to thereby rotate the rotor so as to open the check valve and allow operating oil in the second pressure chamber to flow into the first pressure chamber through a first oil hole. When the door is closed, the rotor and the main shaft are reversely rotated by the recovery force of the torsion spring to thereby close the door. In accordance with the invention, there is provided a braking apparatus for this door closer in which a second and a third oil hole are communicated to the second pressure chamber and the first pressure chamber, respectively, a communicating oil hole is formed in a circumferential wall of the cylinder so as to communicate with the second and third oil holes, and the braking apparatus comprises a slide valve arranged so as to be slidable in the communicating hole in the axial direction thereof, which slide valve is provided with a valve rod having a head portion and a braking valve portion formed at a top of the rod and a position corresponding to the third oil hole, respectively, and dimensioned so as to be tightly fitted in the communicating hole; an elastic member urging the slide valve in the direction opposite to the direction of flow of the operating oil when the door is closing so as to cause the slide valve to fit into the communicating hole; and an adjusting screw threadedly engaged with an opening portion of the communicating hole for positioning the slide valve in the axial direction.

BRIEF DESCRIPTION OF THE DRAWINGS

Other features and advantages of the invention will be apparent from the following description taken in connection with the accompanying drawing wherein.

DESCRIPTION OF THE PREFERRED EMBODIMENTS

A preferred embodiment of the present invention will now be described in detail with reference to the accompanying drawings.

Figure 1:
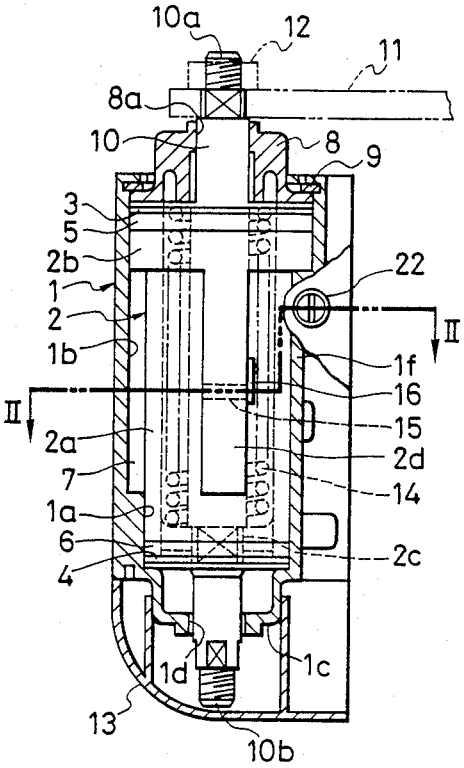
FIG. 1 is a front view, partially in section, showing a preferred embodiment of a braking apparatus for a door closer according to the present invention.
Figure 2:
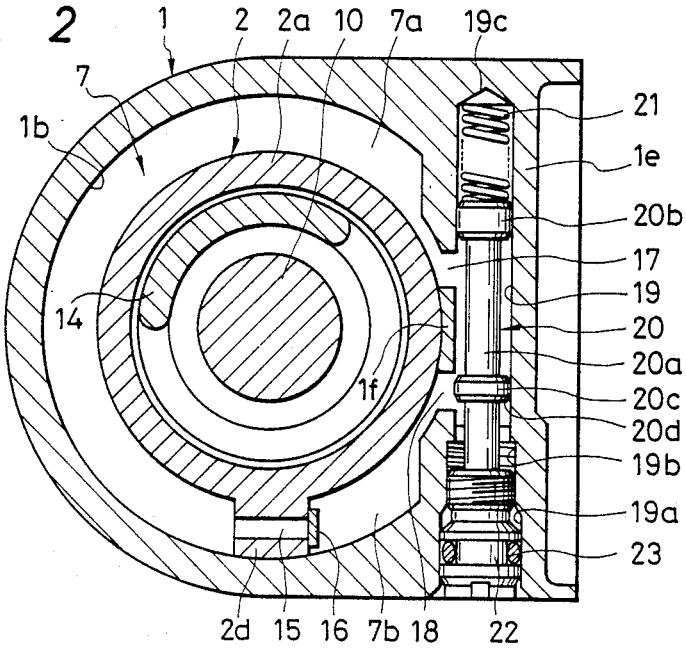
FIG. 2 is an enlarged cross section taken on a line II—II in FIG. 1.

Referring to FIGS. 1 and 2, a vertically elongated cylinder 1 has a lower small inner diameter portion 1*a* and an upper large inner diameter portion 1*b*. Corresponding to the inner diameter portions of the cylinder 1, a rotor 2 has a lower small diameter portion 2*a* and an upper large diameter portion 2*b*. The rotor 2 is rotatably fitted into the cylinder 1 in a fluid-tight manner with O-rings 5 and 6 respectively fitted in grooves 3 and 4 circumferentially formed in a peripheral wall of the cylinder 1 in the vicinity of the opposite ends thereof. Thus, an operating oil holding chamber 7 having a substantially annular cross section is defined between the large diameter portion 1*b* of the cylinder 1 and the small diameter portion 2*a* of the rotor 2.

The illustrated cylinder 1 has a closed lower end and an open upper end. A bearing member 8 for use also as an end plug is fixed by a stop ring 8*a* at the upper end opening of the cylinder 1 to thereby prevent the rotor 2 from coming off.

The rotor 2 has a hollow portion and a bottom portion. A main shaft 10 passes through the rotor 2 along the longitudinal center thereof.

The upper end of the main shaft 10 passes through a center hole 8*a* of the bearing member 8 so as to be supported by the bearing member 8, and an arm 11 is fixed to an outwardly projecting end 10*a* of the main shaft 10 by a stop screw 12 so as to be rotatable together with the main shaft 10. The lower end of the main shaft 10 passes through a through-hole 2*c* formed at the center of the bottom wall of the rotor 2 and projects outwards through a through-hole 1*d* formed in a bottom wall 1*c* of the cylinder 1. The lower projecting end 10*b* of the main shaft 10 is normally covered with a cover 13; however, the cover 13 can be removed as required so that the above-mentioned arm 11 can be fixed to the lower projecting end 10*b*.

A torsion spring 14 is provided in a space defined inside the rotor 2 between the inner circumferential surface of the rotor 2 and the main shaft 10. The upper and lower ends of the torsion spring 14 are fixedly engaged with the main shaft 10 and the rotor 2, respectively, so that the rotor 2 and the bearing member 8 are interlocked with each other and the torsion spring 14 is subject to torsion by the main shaft 10 rotated during the door opening operation. The torsion spring 14 is mounted in the space so as to contact the inner circumferential surface of the rotor 2 in such a manner as to not be bent relative to the center axis while under torsion.

Further, a defining wall 1*f* projects from the inner surface of a circumferential wall 1*e* of the cylinder 1 to circumferentially define the chamber 7, and the outer circumferential surface of the rotor 2 contacts in a fluid-tight manner with the inner surface of the defining wall 1*f*.

A blade 2*d* projects outwardly from the outer wall surface of the rotor 2 and contacts in a fluid-tight manner with the inner surface of the cylinder 1. The chamber 7 is divided into a second pressure chamber 7*a* and a first pressure chamber 7*b* by the blade 2*d*, the inner surface of the cylinder 1, and the defining wall 1*f*.

An oil hole 15 is formed in the blade 2*d* through which the second pressure chamber 7*a* and the first pressure chamber 7*b* can be communicated with each other. A self-closing check valve 16 is provided in the oil hole 15 at the first pressure chamber 7*b* side so that the check valve 16 is opened by the pressure of the operating oil owing to the clockwise rotation of the rotor 2 in FIG. 2 caused by the door opening operation.

Oil holes 17 and 18 respectively communicating with the second pressure chamber 7*a* and the first pressure chamber 7*b* are formed in the circumferential wall 1*e* of the cylinder 1 at the opposite sides of the defining wall 1*f*, and a communicating oil hole 19 is formed in the circumferential wall le of the cylinder 1 transversely in the direction substantially perpendicularly to the longitudinal direction of the cylinder 1 so as to communicate with the holes 17 and 18.

The illustrated communicating oil hole 19 has its bottom end closed and the other end opened to form an opening portion 19*a*. The opening portion 19*a* is made larger in diameter than other portions and is threaded at the inner surface thereof to define a screw hole 19*b*.

A slide valve 20 is fitted in the communicating oil hole 19 so as to be axially slidable. The slide valve 20 is provided with a valve rod 20*a* reduced in diameter by a suitable value with respect to the inner diameter of the communicating oil hole 19. The valve rod 20*a* has a head portion 20*b* formed at a position on the valve rod 20*a* corresponding to the communicating oil hole 19 at the first pressure chamber 7*b* side. The head portion 20*b* and the valve portion 20*c* are shaped to fit in the communicating oil hole and are axially separated from each other by a distance larger than the interval between the oil holes 17 and 18. An elastic member 21, disposed inside the communicating oil hole 19, is supported at its opposite ends by a bottom portion 19*c* of the communicating oil hole 19 and the above-mentioned head portion 20*b* so that the slide valve 20 is urged by the spring force of the elastic member 21 in the direction counter to the operating oil flow direction in the door closing operation, that is, in the downward direction in FIG. 2. The slide valve 20 is supported at it rear end by an adjusting screw 22 screwed into an opening portion of the communicating oil hole 19. Hence, not only is the slide valve 20 prevented from coming off, but also the axial position of the slide valve 20 can be adjusted by advancing/retreating the adjusting screw 22.

That is, the slide valve 20 is normally adjusted by the adjusting screw 22 so as to be held at the position shown in FIG. 2 in which the communicating oil hole 19 communicated with the oil holes 17 and 18 is not closed by the valve portion 20*c* so that, in the door closed state shown in FIG. 2, the second pressure chamber 7*a* and the first pressure chamber 7*b* are maintained in communication with each other because the communicating oil hole 19 is communicated with each of the oil holes 17 and 18.

Further, the adjusting screw 22 is threadedly engaged with the screw hole 19*b* of the communicating oil hole 19 in a fluid-tight manner through an O-ring 23.

The cylinder 1 is fixed to a door (not shown), and the top end of the arm 11 is pivotally attached to the top end of another arm (not shown) having a base end pivoted to a door attaching frame (not shown).

In such an arrangement, when the door is opened, the main shaft 10 is rotated clockwise by the arm 11 from the position in the closed state shown in FIG. 2. Simultaneously, the torsion spring 14 is twisted in the same direction as the main shaft so as to rotate the rotor 2 clockwise, as indicated by an arrow a in FIG. 3, and the blade 2*d* is also rotated in the same direction so that the check valve 16 is opened by the operating oil at that time to allow the operating oil in the second pressure chamber 7*a* to flow into the first pressure chamber 7*b* through the oil hole 15. Thus, the door can be opened through a predetermined angular range.

Figure 3:
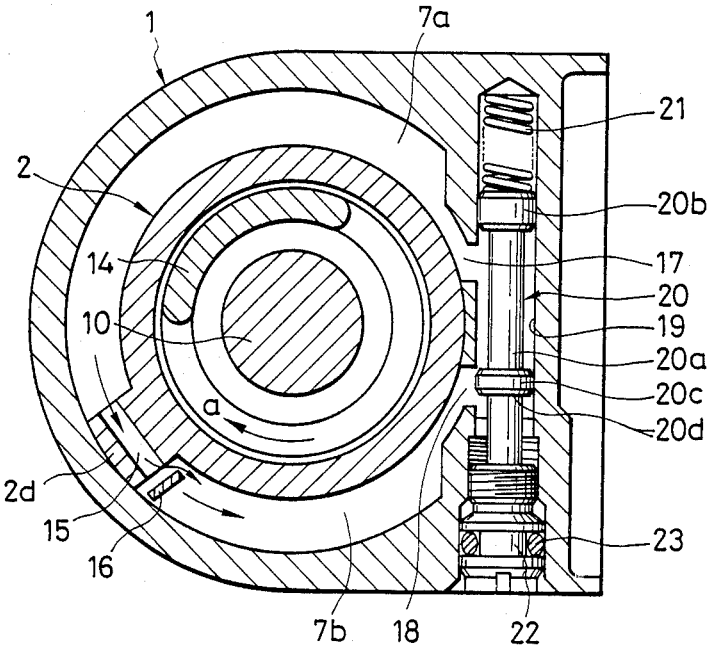
FIGS. 3 through 5 are enlarged cross sections showing various operating states of the braking apparatus in the embodiment of FIG. 2.
Figure 4:
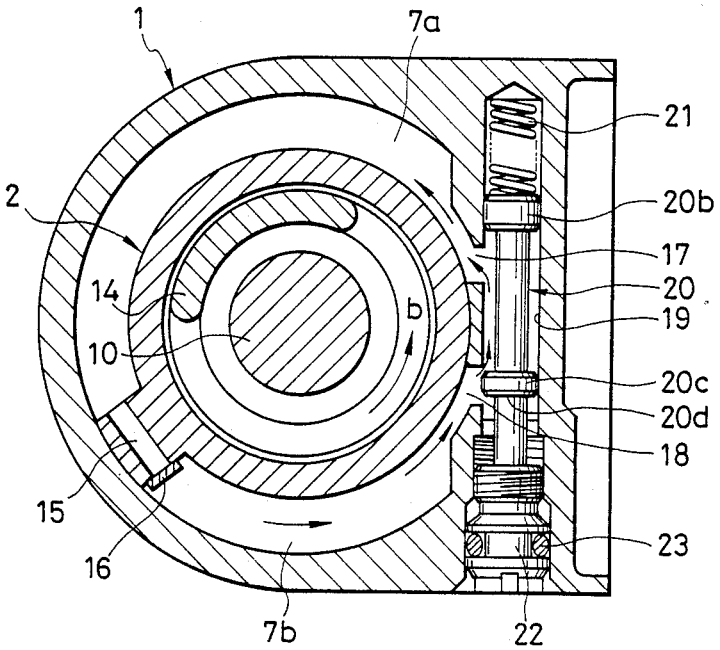

When the door opening force is released, the check valve 16 is closed and the rotor 2 and the main shaft 10 receive a rotating force due to the recovery force of the torsion spring 14, this force acting counter-clockwise in FIG. 3, that is, in the direction of an arrow b in FIG. 4, so that the operating oil in the first pressure chamber 7*b* flows into the second pressure chamber 7*a* through the oil hole 18, the communicating oil hole 19, and the oil 17. Thus, the rotor 2 and the main shaft 10 are rotated in the direction of the arrow b to close the door. The flow rate of the operating oil is adjusted by the slide valve 20, the position of which is set by the adjusting screw 22 and the elastic member 21.

If an external force such as wind pressure or the like is exerted on the door in the door closing direction when the door is being closed, the rotor 2 receives a rotating force in the direction indicated by the arrow b in FIG. 4 through the arm 11 and the main shaft 10. Hence, the first pressure chamber 7*b* is pressurized so that the interior pressure thereof rapidly increases, and the force created by the inner pressure applied to the side surface 20*d* of the valve portion 20*c* of the slide valve 20 becomes larger than that in the normal state described above. Accordingly, the slide valve 20 slides upwardly in the drawing while compressing the elastic member 21 so that the valve portion 20*c* cuts off communication between the oil hole 18 and the communicating oil hole 19 to inhibit the operating oil from flowing and to thereby brake the movement of the door.

Figure 5:
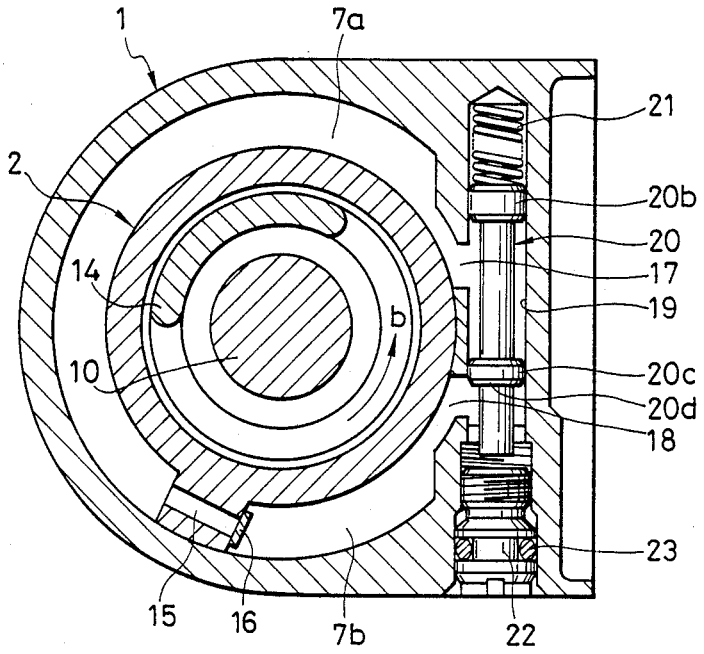

When the external force in the door closing direction is removed, the inner pressure of the first pressure chamber 7*b* is decreased to the normal state, whereby the slide valve 20 is slid downwardly in the drawing by the spring force of the elastic member 21 from the state of FIG. 5 to return to the state of FIG. 4, and hence the flow path of the operating oil, which was blocked by the valve portion 20*c*, is opened so that the normal door closed state is recovered.

The spring constant of the elastic member 21 is selected so that the elastic member 21 is not compressed in the normal door closing operation.

In the illustrated embodiment, a compression spring is used as the elastic member 21. However, the elastic member is not limited to this construction, but, for example, may be made of urethane, a rubber material, or the like.

Although the apparatus according to the invention is described with reference to a vertical-type door closer in the illustrated embodiment, the invention is not limited to this application, and can be applied to a horizontal-type door closer.

As described above, the braking apparatus for a door closer according to the present invention is arranged such that the communicating oil hole 19 is formed in the circumferential wall 1*e* of the cylinder 1 so as to communicate with each of the oil holes 17 and 18 respectively communicated with a second pressure chamber 7*a* and a first pressure chamber 7*b* formed in the cylinder 1, and a slide valve 20 provided with a valve rod 20*a* having a head portion 20*b* and a valve portion 20*c*, which are enlarged in diameter and formed at a top end portion and a position corresponding to the oil hole 18, respectively, is slidably disposed in the communicating hole 18 in a such manner that the slide valve 20 is urged by an elastic member 21 in the direction opposite to the operating oil flow direction in the door closing operation. The position of the slide valve 20 can be adjusted by the elastic member 21 and an adjusting screw 22.

Accordingly, not only can the door opening/closing speed be adjusted as desired by suitably adjusting the amount of flow of the operating oil, but, in the case where an external force acting in the door closing direction is applied in the door closing operation, the force exerted on the valve portion 20*c* of the slide valve 20 becomes large owing to the increase in the inner pressure of the first pressure chamber 7*b* so as to make the slide valve 20 slide against the spring force of the elastic member 21 to thereby cut off communication between the communicating oil hole 19 and the oil hole 18 of the first pressure chamber 7*b* with the valve portion 20*c*, so as to stop the operating oil from flowing, and to thereby brake the door and hence prevent the door from closing rapidly. Further, since the slide valve 20 contacts the inner surface of the communicating hole 19 at two portions, namely, the head portion 20*b* and the valve portion 20*c*, the slide valve 20 slides smoothly when the inner pressure of the pressure chamber 7 rises rapidly, as described above, so that tilting of the slide valve 20 never occurs, the valve operation can be surely performed, and the braking operation can be carried out accurately.

What is claimed is:

1. In a door closer comprising a main shaft, a torsion spring, a rotor, a cylinder, a first pressure chamber and a second pressure chamber formed in said cylinder, and a check valve provided on a blade provided within said cylinder, wherein, when a door to which said closer is connected is opened, said torsion spring is subjected to torsion by said main shaft to thereby rotate said rotor so as to open said check valve to allow operating oil in said second pressure chamber to flow into said first pressure chamber through a first oil hole, and when said door is closed, said rotor and said main shaft are reversely rotated by a recovery force of said torsion spring to thereby close said door, a braking apparatus for said door closer comprising:

a second and a third oil hole formed communicating with said second pressure chamber and said first pressure chamber, respectively;

a communicating oil hole formed in a circumferential wall of said cylinder so as to communicate with said second and third oil holes;

a slide valve slidably positioned in said communicating hole in the axial direction thereof and provided with a valve rod having a head portion and a braking valve portion which are formed at one end of said valve rod and a position corresponding to said third oil hole, respectively, so as to be tightly fit in said communicating hole;

an elastic member urging said slide valve in the direction opposite to a flow direction of said operating oil when said door is closing so as to cause said slide valve to fit into said communicating hole; and an adjusting screw threadedly engaged in an opening portion of said communicating hole for positioning said slide valve in said axial direction.

2. The door closer as recited in claim 1, wherein said communicating oil hole extends generally perpendicular to a longitudinal direction of said cylinder.

3. The door closer as recited in claim 1, wherein an axial distance between said head portion and said braking valve portion is larger than an interval between said second and third oil holes.

4. The door closer as recited in claim 1, wherein said elastic member comprises a coil spring.

5. The door closer as recited in claim 3, wherein said elastic member comprises a rubber member.

6. The door closer as recited in claim 3, wherein said elastic member comprises a urethane member.

* * * * *